United States Patent [19]

Reiser et al.

[11] 4,037,790

[45] July 26, 1977

[54] WATER GLOVE

[76] Inventors: Roger W. Reiser, 3697 Hillcrest Road; Gary K. Summers, 2440 Pearl St., both of Dubuque, Iowa 52001

[21] Appl. No.: 672,626

[22] Filed: Apr. 1, 1976

[51] Int. Cl.[2] ..... B05B 9/08

[52] U.S. Cl. ..... 239/529; 222/175; 272/27 W

[58] Field of Search ..... 46/1 R, 1 E; 272/27 N, 272/27 W; 222/78, 79, 192, 175; 239/211, 274, 289, 327, 328, 375, 529

[56] References Cited

U.S. PATENT DOCUMENTS

| | | | |
|---|---|---|---|
| 836,181 | 11/1906 | Cray | 239/529 |
| 1,177,412 | 3/1916 | Hopkins | 239/529 |
| 1,534,208 | 4/1925 | Gibson | 239/529 X |
| 1,983,461 | 12/1934 | Howett | 272/27 W |

FOREIGN PATENT DOCUMENTS

| | | | |
|---|---|---|---|
| 914,079 | 6/1954 | Germany | 239/529 |
| 651,879 | 4/1951 | United Kingdom | 222/79 |

*Primary Examiner*—John J. Love

*Attorney, Agent, or Firm*—Clarence A. O'Brien; Harvey B. Jacobson

[57] ABSTRACT

A toy which expels a liquid from the wrist area of a glove by applying pressure to the palm portion of the glove has a compressible bulb disposed at the palm portion of the glove and connected to a tube which extends into an aperture provided in a gauntlet provided on the glove. The tube terminates in a nozzle directed toward the palm portion of the glove so as to spray the liquid onto the hand of a person grasping the user's glove hand, or toward an object upon the user's making a fist with the glove hand. A valve connected to the compressible bulb is provided in the palm portion of the glove for permitting refilling of the bulb with the medium to be sprayed.

7 Claims, 5 Drawing Figures

WATER GLOVE

BACKGROUND OF THE INVENTION

1. Field of the Invention

This invention relates generally to toys, and particularly to a novelty device for expelling a medium upon the application of pressure to a user's hand.

2. Description of the Prior Art

Novelty toys are known which are intended to be worn on a user's hand and spray a liquid medium at another person under an application of a force to the toy. For example, U.S. Pat. No. 594,595, issued Nov. 30, 1897 to O. Brethauer, discloses a finger-ring having attached thereto a rubber ball containing a quantity of water, cologne, or other suitable medium, for forcing the medium through a passage in the ring and toward a target. U.S. Pat. No. 3,353,749, issued Nov. 21, 1967 to H. A. Lahaug, shows a ring structurally similar to the ring of U.S. Pat. No. 594,595, but primarily intended for defending the wearer from an assailant by discharging an obnoxious gas. Crime prevention is also the intent of the liquid projecting device set forth in U.S. Pat. No. 1,923,979, issued Aug. 22, 1933, to C. E. Howett, which device is concealable in a stack of paper money, and the like.

We are also aware of the following patents that might be pertinent to the invention:

| | | |
|---|---|---|
| 1,845,735 | S.S. Adams | Feb. 16, 1932 |
| 2,729,024 | F. Guttmann | Jan. 3, 1956 |
| 2,831,206 | D.D. Curtis | April 22, 1958 |
| 3,217,928 | H. Burbig | Nov. 16, 1965 |

SUMMARY OF THE INVENTION

It is an object of the present invention to provide an entertaining fluid-dispensing novelty toy which may be worn on the hand of a user.

It is another object of the present invention to provide a safe, reliable, and harmless liquid dispensing novelty toy which may be used by persons of any age.

These and other objects are achieved according to the present invention by providing a novelty device having: a spray arrangement capable of containing a predetermined amount of a suitable medium, such as water, to be sprayed and discharging the medium in response to an application of pressure on at least a portion of the device; and a carrying arrangement connected to the spray arrangement for supporting the spray arrangement on a user's hand and causing the spray arrangement to be subjected to the aforementioned application of pressure whenever the user's hand is grasped as by the hand of another person or by the making of a fist by the user.

According to a preferred embodiment of the invention, the carrying arrangement is in the form of a glove arranged to be worn on a user's hand and provided with an aperture in a gauntlet forming part of the glove. A compressible bulb is arranged in a palm portion of the glove for containing the amount of medium to be sprayed, while a nozzle member connected to the compressible bulb is arranged in the aperture provided in the gauntlet for directing the medium from the compressible bulb toward the palm portion of the glove. While the spray is not intended necessarily to be directed onto the palm portion of the glove, the spray will be directed in the general direction of the palm portion so as to strike the hand of a person grasping the user's glove hand.

A shroud is advantageously disposed over the aperture provided in the gauntlet of the glove for assisting in directing the nozzle member toward the palm portion of the glove. The nozzle member is preferably a length of tubing connected to and extending from the bulb to the aperture and terminating in an exit nozzle coextensive with a terminal portion of the shroud.

Further, it is desirable to provide an opening in the palm portion of the glove and arranging in this opening a valve means connected to the compressible bulb for permitting the medium to be sprayed to be injected into the compressible bulb as by a flexible container provided with a suitable nozzle for insertion into the valve means.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
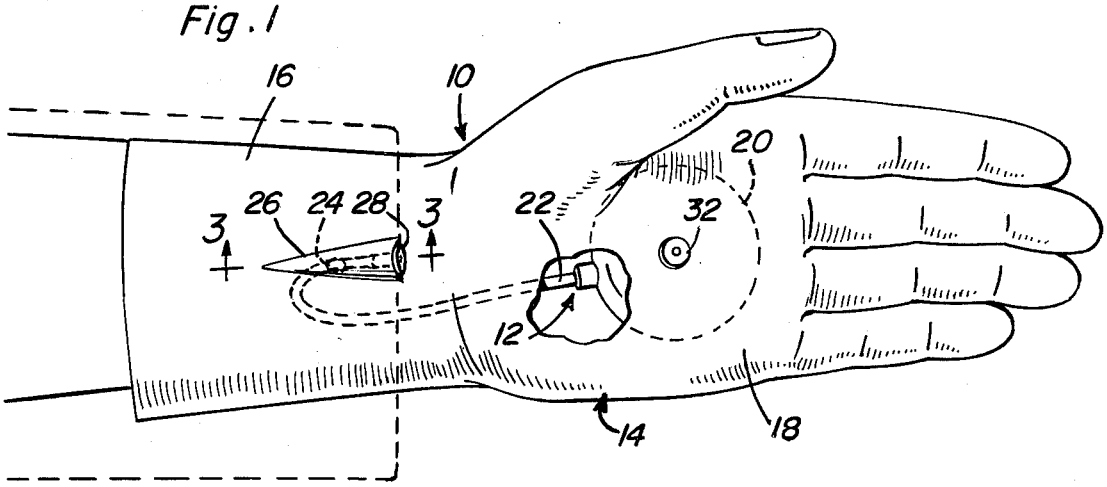
FIG. 1 is a top plan view, partly broken away, showing a water glove toy according to the present invention arranged on the hand of a user.
Figure 2:
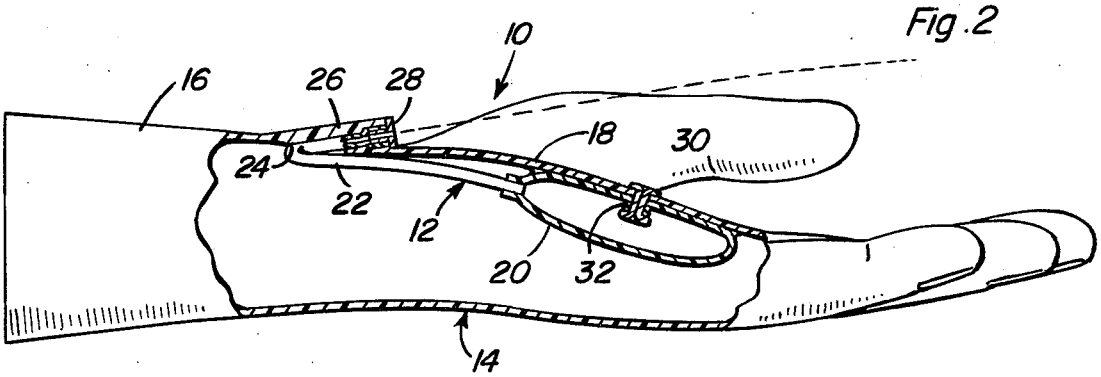
FIG. 2 is a side elevational view, partly broken away and in section, showing the water projecting glove of FIG. 1.

Referring now more particularly to FIGS. 1 and 2, a novel device or toy in the form of a water projecting glove 10 has a spray system 12 for containing an amount of medium to be sprayed and discharging the medium, which may be a suitable liquid such as water, in response to an application of pressure onto the system 12. A carrying structure in the form of a glove 14 arranged to be worn on a user's hand is provided for supporting the spray system 12 on the user's hand and causing the spray means to be subjected to an application of pressure whenever, for example, the user's hand is grasped by the hand of another person (not shown). Glove 14 includes a wrist area or gauntlet 16 and a palm portion 18, both of which are associated with the spray system 12.

Spray system 12 includes a compressible bulb 20, constructed from a soft natural or synthetic rubber, and the like, arranged in the palm portion 18 of glove 14 and capable of containing an amount of the medium to be sprayed. System 12 also includes a nozzle member in the form of a length of tube 22 connected to bulb 20 and in communication therewith, and arranged in an aperture 24 provided in the gauntlet 16 of glove 14 so as to direct the medium to be sprayed from the compressible bulb 20 to an exit point from glove 14 adjacent the aperture 24. As can be readily appreciated from the drawings, the outwardly terminal end of tube 22, which may be constructed from a suitable flexible material such as polyvinyl chloride, is arranged in the aperture 24 so as to have the exit thereof directed toward, but not necessarily at, the palm portion 18 of glove 14.

The compressible bulb 20 is disposed immediately adjacent the palm portion 18 of the glove so as to be compressed whenever the user's hand is grasped as by another hand or by the user making a fist. In this manner, it will be appreciated that the spray exiting from tube 22 will be directed out past the palm portion 18 of glove 14 so as to contact the hand of the other party or any other object which the user decides to spray.

Figure 3:
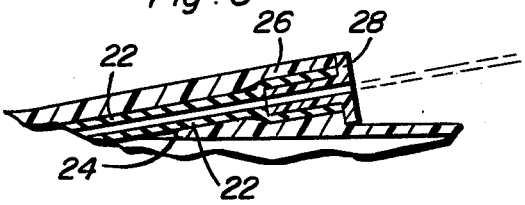
FIG. 3 is a fragmentary, enlarged, sectional view taken generally along the line 3—3 of FIG. 1.

Referring now more particularly to FIG. 3, a shroud 26 is advantageously disposed over the aperture 24 provided in gauntlet 16 of glove 14 for directing the tube 22 toward, or in the general direction of, the palm portion 18. Tube 22 is connected at one end to the compressible bulb 20, and at its other, or exit end terminates in an exit nozzle 28 coextensive with the outer terminating surface of the diverging surface of the shroud 26. In this manner, the proper orientation of the discharge from tube 22 is assured.

Figure 4:
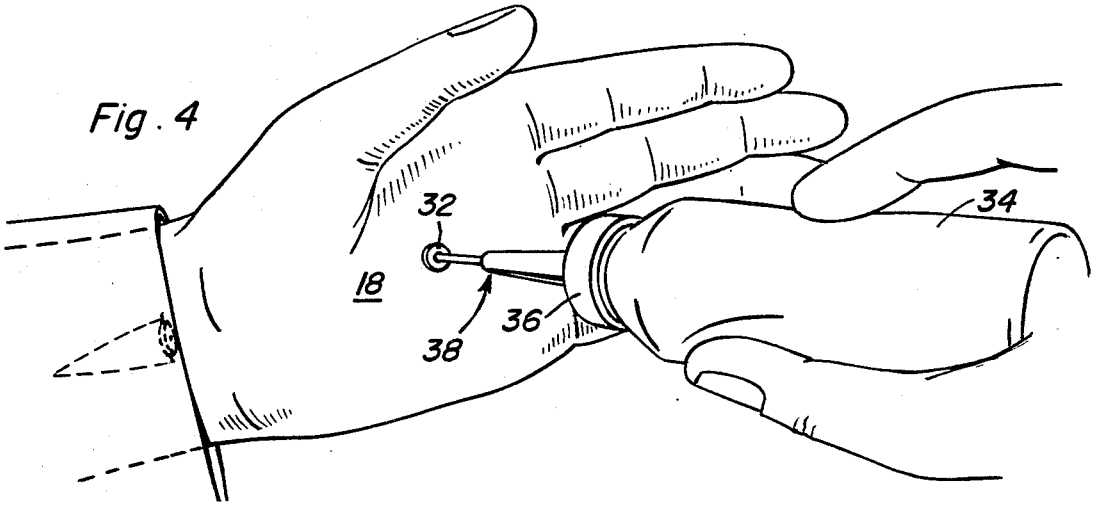
FIG. 4 is a perspective view showing the water projecting glove being refilled with a medium to be sprayed.

Referring now to FIG. 4 in conjunction with FIGS. 1 and 2, it will be seen that an opening 30 is provided in the palm portion 18 of the glove 14, and that a suitable valve 32 is arranged in this opening 30 and is connected to the compressible bulb 20 for permitting medium to be sprayed to be injected into the bulb 20. More specifically, valve 32 may be constructed from a suitable resilient material, such as a natural or synthetic rubber, so as to contract along the internal passage thereof and prevent the medium from being forced out of bulb 20 through the central passage of the valve 32 when a force is applied to the palm portion 18 of glove 14, and accordingly to bulb 20.

Figure 5:
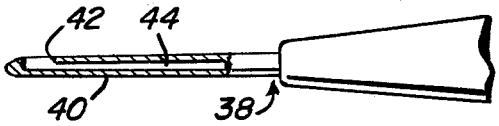
FIG. 5 is a fragmentary, side elevational view, partly broken away and in section, showing the needle portion of a container used to refill the water projecting glove with a medium to be sprayed.

When it is desired to inject an additional quantity of the medium to be sprayed into the compressible bulb 20, a container 34, constructed from a suitable flexible material such as polyethylene, is first itself filled with the medium to be sprayed by removing the cap 36 of the container 34. Once container 34 is filled with a predetermined amount of the medium to be sprayed, a needle 38 (FIG. 5) attached to cap 36 and having a stem 40 terminating in an orifice 42 connected with the interior of container 34 as by a passage 44 is inserted into the central passage of valve 32 so as to bring the orifice 42 and passage 44 in communication with the interior of bulb 20. Thus, done, an application of pressure, or squeezing, of the side walls of container 34 will cause the medium to be forced from the interior of container 34, through passage 44 and orifice 42 and into the interior of bulb 20 so as to recharge bulb 20 for further use of the water projecting glove 10.

As will be appreciated from the above description and from the drawings, a water projecting glove according to the invention provides an inexpensive, simple, yet reliable and safe amusement for use by persons of all ages, and especially by children.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A novelty device, comprising, in combination:
   a. spray means for containing an amount of medium to be sprayed and discharging the medium in response to an application of pressure thereon; and
   b. carrying means connected to the spray means for supporting the spray means on a user's hand and causing the spray means to be subjected to an application of pressure whenever the user's hand has a force applied thereto, the carrying means being a glove arranged to be worn on a user's hand and being provided with an aperture for permitting discharge of the medium from the spray means, the spray means including:
      1. a compressible bulb arranged for containing an amount of medium to be sprayed and for being subjected to a force applied to the glove; and
      2. a nozzle member connected to the bulb and arranged in the aperture provided in the glove for directing the medium from the compressible bulb and out of the glove, the glove including a gauntlet and a palm portion, and wherein the aperture is disposed in the gauntlet and the nozzle member is directed in the general direction of the palm portion from the gauntlet.

2. A structure as defined in claim 1, wherein the compressible bulb is disposed immediately adjacent the palm portion of the glove so as to be compressed whenever the user's hand is grasped.

3. A structure as defined in claim 1, further including a shroud over the aperture for directing the nozzle member in the general direction of the palm portion of the glove, the nozzle member being a length of tubing connected to and extending from the compressible bulb to the aperture and terminating in an exit nozzle coextensive with an extent of the shroud toward the palm portion of the glove.

4. A structure as defined in claim 1, wherein an opening is provided in the palm portion of the glove, and further including valve means arranged in the opening and connected to the compressible bulb for permitting medium to be sprayed to be injected into the compressible bulb for refilling same.

5. A structure as defined in claim 4, wherein the compressible bulb is disposed immediately adjacent the palm portion of the glove so as to be compressed whenever the user's hand is grasped.

6. A structure as defined in claim 4, further including a shroud over the aperture for directing the nozzle member in the general direction of the palm portion of the glove, the nozzle member being a length of tubing connected to and extending from the compressible bulb to the aperture and terminating in an exit nozzle coextensive with an extent of the shroud toward the palm portion of the glove.

7. A structure as defined in claim 6, wherein the compressible bulb is disposed immediately adjacent the palm portion of the glove so as to be compressed whenever the user's hand is grasped.

* * * * *